US008186907B1

(12) United States Patent
Asplin

(10) Patent No.: US 8,186,907 B1
(45) Date of Patent: May 29, 2012

(54) SLAB LEVELING SYSTEM AND METHOD

(76) Inventor: Charles Lee Asplin, Fargo, ND (US)

( * ) Notice: Subject to any disclaimer, the term of this patent is extended or adjusted under 35 U.S.C. 154(b) by 0 days.

(21) Appl. No.: 09/687,445

(22) Filed: Oct. 13, 2000

(51) Int. Cl.
*E01C 23/10* (2006.01)

(52) U.S. Cl. ..... 404/78

(58) Field of Classification Search ..... 521/742.13, 521/742.14, 742.16; 406/127, 153, 136; 404/78
See application file for complete search history.

(56) References Cited

U.S. PATENT DOCUMENTS

| | | | | | |
|---|---|---|---|---|---|
| 1,915,032 | A | * | 5/1930 | Poulter | 404/78 |
| 1,943,914 | A | * | 1/1934 | Fiock | 404/78 |
| 2,007,457 | A | * | 7/1935 | Peters | 404/78 |
| 2,041,266 | A | * | 5/1936 | Poulter | 94/23 |
| 2,074,756 | A | * | 3/1937 | Poulter | 94/39 |
| 4,194,726 | A | | 3/1980 | Hance | 254/133 |
| 4,420,957 | A | | 12/1983 | Weber | 72/1 |
| 4,466,760 | A | * | 8/1984 | Feldsted | 406/41 |
| 4,511,291 | A | * | 4/1985 | Quates, Sr et al. | 406/128 |
| 4,567,708 | A | * | 2/1986 | Haekkinen | 52/743 |
| 4,592,679 | A | * | 6/1986 | Boiting et al. | 406/127 |
| 4,646,482 | A | * | 3/1987 | Chitjian | 451/87 |
| 4,839,969 | A | | 6/1989 | Hahn | 34/169 |
| 4,850,752 | A | | 7/1989 | Carey-Yard | 406/153 |
| 4,878,320 | A | | 11/1989 | Woodson | 51/320 |
| 4,962,913 | A | | 10/1990 | Stewart | 254/269 |
| 5,081,799 | A | | 1/1992 | Kirschner et al. | 51/410 |
| 5,083,402 | A | | 1/1992 | Kirschner et al. | 51/319 |
| 5,230,185 | A | | 7/1993 | Kirschner et al. | 51/410 |
| 5,239,788 | A | | 8/1993 | Woodson | 51/436 |
| 5,325,638 | A | | 7/1994 | Lynn | 51/320 |
| 5,558,474 | A | * | 9/1996 | Wildon | 408/127 |
| 5,561,914 | A | * | 10/1996 | Asplin | 34/165 |
| 5,577,446 | A | | 11/1996 | Perry et al. | 104/2 |
| 5,795,108 | A | * | 8/1998 | Lightle | 406/48 |
| 5,860,763 | A | | 1/1999 | Asplin | 404/78 |
| 5,974,611 | A | * | 11/1999 | Casella | 15/3.52 |
| 6,068,425 | A | | 5/2000 | Fershtut | |
| 6,558,071 | B1 | * | 5/2003 | Sproules | 404/78 |
| 6,976,804 | B1 | | 12/2005 | Asplin | |

* cited by examiner

*Primary Examiner* — Raymond W Addie
(74) *Attorney, Agent, or Firm* — Hamre, Schumann, Mueller & Larson, P.C.

(57) ABSTRACT

A system for leveling a slab by raising and filling in voids under the slab. A mixture of compressed air and well dried sand is pumped through hose to a gun nozzle. The slab to be leveled is supplied with at least one hole for receiving the gun nozzle in a fluid tight connection. The compressed air is used to lift the slab while the sand is used to fill the void and keep the slab in a level position. The operator may supply successive burst of pressure to lift the slab as needed, while adjusting the air and sand flow. Finally, the gun nozzle is removed from the hole which is then patched thus, completing the repair of the damaged slab.

18 Claims, 4 Drawing Sheets

FIG 2
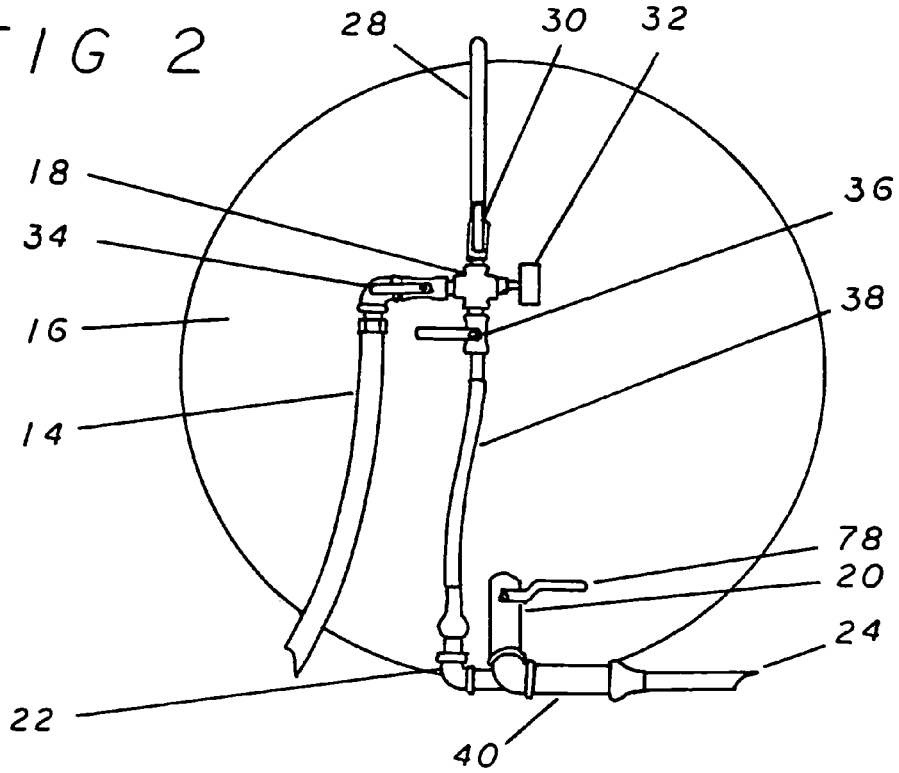
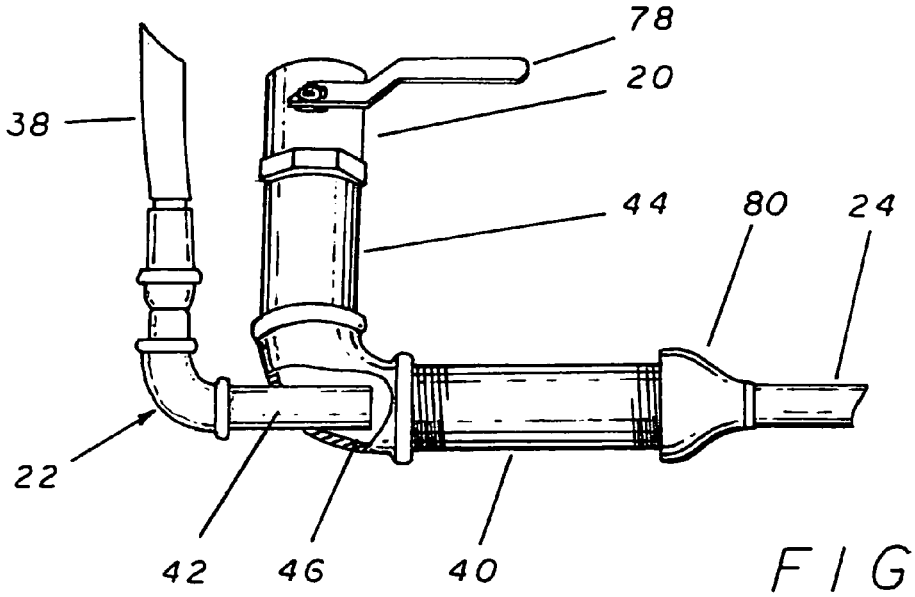
FIG 3

FIG 4
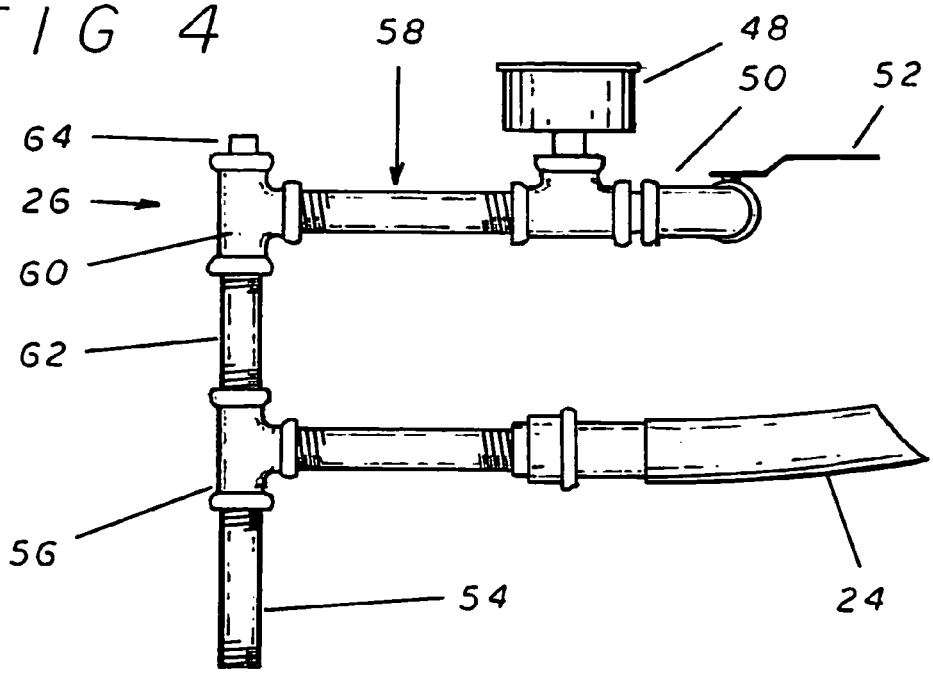
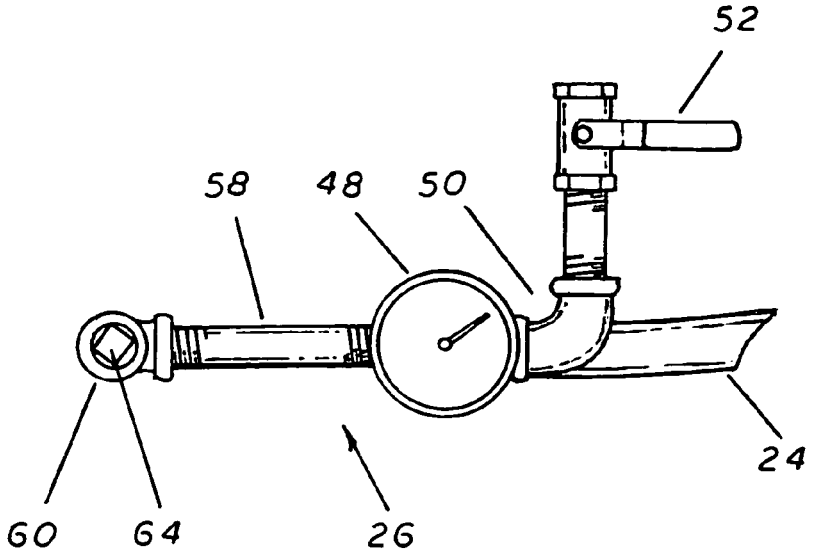
FIG 5

SLAB LEVELING SYSTEM AND METHOD

BACKGROUND OF THE INVENTION

The present invention relates to a method of leveling an existing concrete slab which has had portions settle into the ground so as to become uneven over time. More specifically, to a method of carefully raising a section of the sunken slab so as not to damage the section and allow for the injection of pressurized mason's sand into the cavity created between the bottom of the uneven slab and the settled ground.

Regardless of the care and skill used in the initial construction, concrete slabs tend to become misaligned over time due to different rates of settlement of the earth. Uplift from freeze/thaw cycles or tree root lifting are also common causes of slab misalignment. These problems cause cracks in the slab to develop and can also cause step-like structures to occur between sections of the slab. The end result of this condition is the creation of hazards to users and liability for those who are responsible for their care. Additionally, the uneven slabs are extremely difficult to clear of snow and ice during the winter months in the northern areas of the United States, thus creating further hazards and liabilities for their users and owners.

In the past, there was a number of ways these problems were solved. One of these was to completely remove the damaged section of the slab and then re-pour it. The problem with this method is that although it works very well, it is time consuming and very expensive. The re-pour method also results in a checkerboard looking slab as the new portions are often a very different color from the older weathered sections. Another method that has been used with the step formation problem is to construct concrete or tar ramps from the lower section of the slab to the upper. The problem with this method is that it still leaves uneven slab surfaces that are hazardous and difficult to maintain.

Finally, another method that is often used is mud jacking. In this repair method a hole is drilled through the uneven slab and wet mud is pumped under the slab until the slab becomes level. The main problem with this method is that it may be difficult to effectively level a slab as the mud will settle over time while drying.

Therefore, from the foregoing discussion it can be clearly seen that it would be desirable to provide a means of leveling existing large slabs in an inexpensive manner that is easily used.

SUMMARY OF THE INVENTION

It is the primary objective of the present invention to provide a method of repairing driveways or other similar concrete slabs that have become uneven and damaged due to settling or other changes in the elevation of the earth upon which they are built.

It is an additional objective of the present invention to provide such a method of repairing driveways or other similar slabs which is economical and efficient in operation.

It is a further objective of the present invention to provide such a method of repairing sidewalks that is highly transportable and that can be easily operated.

These objectives are accomplished by the use of a portable high volume air compressor that is connected to a sand storage tank by the use of a high pressure air line. The connection at the sand storage tank is accomplished through an air manifold which is primarily a splitter mechanism which allows the single line of air flow from the air compressor to be diverted to a number of possible different paths. One of these possible paths is through the manifold bleed line which extends up over the sand tank and serves the purpose of providing a mechanism by which any excess or unneeded air pressure existing at the manifold can be vented from the system. The manifold also provides the point of attachment for the manifold pressure gauge which allows the user to closely monitor and control the air pressure within the system.

The tank manifold also provides the point at which the fl compressed air is diverted to the remaining components of the present invention. The air travels from this point through the venturi line to the venturi chamber where it first comes into contact with the mason's sand that is exiting the storage tank through the sand outlet. This sand may typically be a well graded, dry, mason's sand so as to provide optimal compaction. The inflow of highly compressed air into the venturi chamber tends to swirl the sand around inside the mixing chamber which ensures that the flow of compressed air will carry its maximum volume of sand. From the mixing chamber, the mixture of sand and pressurized air passes through the mix chamber venturi which has the effect of increasing the speed and pressure exerted by the sand and air mixture entering the air/sand line.

From this point, the air and sand mixture travels the length of the air/sand line until it gets to the injector gun located at its terminus. The injector gun is the component of the present invention which directs the flow of air and sand into the desired location under the sidewalk slab and is equipped with an external gauge for monitoring pressure at this point and also a bleed off valve. Additionally, the injector gun is manufactured with easily replaceable components as the steady flow of the air and sand mixture through the gun is extremely abrasive which tends to wear the components quickly.

These components of the present invention function together to facilitate the repair of a damaged sidewalk in the following manner. First, once the targeted section of slab has been identified, the operator drills a hole through the slab in a position that is roughly in its center or strategically placed. Once this has been accomplished, the nozzle portion of the injector gun is forced into this hole which forms an air tight seal between the gun nozzle and the sidewalk slab. The operator then opens and closes the post manifold valve in quick successive bursts which forces corresponding bursts of air and sand into the space below the slab. The air pressure in the system is sufficient so that these short bursts will actually lift the sidewalk slab off of the ground which will slightly increase the size of the cavity between the lower surface of the slab and the settled ground. This cavity is then partially filled in by the sand being carried by the air before the slab drops back. The operator simply repeats this process until the settled slab is at the same level as the remaining sidewalk. Finally, the gun nozzle is removed from the hole which is then patched thus, completing the repair of the damaged slab.

For a better understanding of the present invention reference should be made to the drawings and the description in which there are illustrated and described preferred embodiments of the present invention.

DESCRIPTION OF THE DRAWINGS

FIG. 2 is a front elevation view of a the sand storage tank component of the present invention and illustrates the method of construction and orientation of the air manifold and the air/sand mixing venturi.

FIG. 3 is a front elevation cut-away view of the air/sand mixing venturi component of the present invention illustrating the manner in which pressurized air is introduced into the sand flow.

FIG. 4 is a side elevation view of the injector gun component of the present invention illustrating its manner of construction which feature easily replaced parts.

FIG. 5 is a top elevation view of the injector gun component of the present invention illustrating its manner of construction and the locations of the air pressure gauge and the pressure relief valve.

DESCRIPTION OF THE PREFERRED EMBODIMENT

Figure 1:
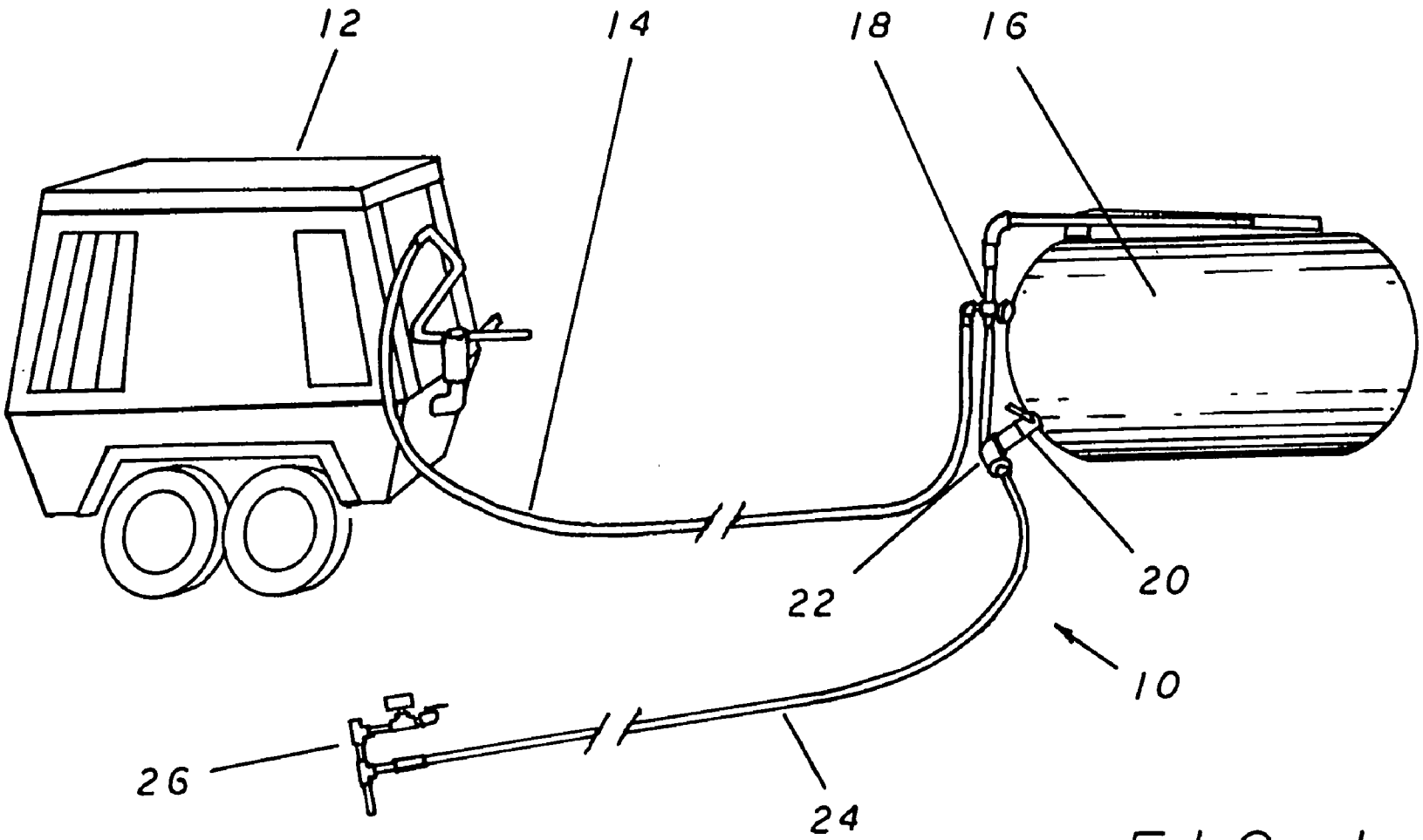
FIG. 1 is a perspective view of the present invention which illustrates the manner in which its individual components are connected together.

Referring now to the drawings, and more specifically to FIG. 1, slab leveling system 10 is made up of three primary components. The first of these is a high volume air compressor 12 which is typically a transportable device having independent wheels and a trailer tongue by which it is pulled to and from a work site. Additionally, the air compressor is most commonly powered by a small gasoline or diesel engine which allows it to be operated independently without the need for an outside power source.

The high volume air compressor 12 is connected to the second primary component of the invention, the sand storage tank 16, by the compressor to tank air line 14 which is simply a length of high pressure air hose that is of an inside diameter that is sufficient to handle the volume of air that is required for the efficient operation of the invention. The connection at the sand storage tank 16 is facilitated by the use of the tank manifold 18 which is a threaded cross apparatus which allows the single compressor to tank line 14 to be split into a plurality of different applications. The primary direction the compressed air takes from the tank manifold 18 is down to the venturi chamber 22 which is located adjacent to the sand outlet 20 at the bottom of the sand storage tank 16.

The venturi chamber serves to mix the sand from the sand storage tank 16 with the compressed air stream for its use in accordance with the theme of the present invention. From the venturi chamber 22, the air and sand mixture is channeled into the air/sand line 24 which transports it to the injector gun 26. The injector gun 26 is the component of the present invention which is employed by the operator to direct the flow of air and sand into the proper location that will effectuate the desired repairs.

The manner of construction of the tank manifold 18 and the venturi chamber 22 are further detailed in FIGS. 2 and 3. The compressor to tank air line 14 enters one of the plurality of ports of the tank manifold 18 through the pre-manifold shutoff valve 34. The pre-manifold shutoff valve 34 allows an operator to close off the air pressure in the compressor to tank air line 14 from the rest of the components of the invention which allows maintenance to be performed without a complete system shut down. This component works partly in conjunction with the manifold bleed line 28 which functions to bleed off air pressure from the system through the bleed line shutoff line 30 located between the tank manifold 18 and the manifold bleed line 28. Thus, this component is employed most commonly in maintenance situations when the air to the system has been closed off by the activation of the pre-manifold shutoff valve 34.

The tank manifold 18 also contains an outlet port which provides the point of attachment for the manifold pressure gauge 32. The manifold pressure gauge 32 provides a point at which the operator can monitor the pressure contained within the system to ensure both that the present invention is operating with enough air pressure so that it operates effectively and under the maximum pressure as prescribed by the design limitations of the invention.

Finally, the tank manifold 18 also provides an outlet port which provides the point of attachment for the manifold to venturi line 38 through the post-manifold shutoff valve 36. The post-manifold shutoff valve 36 is important to the use of the invention as it is the component through which the operator controls the flow of air to the remaining components downline from it. Thus, by opening the post-manifold shutoff valve 36 compressed air will flow to the injector gun 26 which will in turn carry sand to the desired location.

From the post-manifold shutoff valve 36 the manifold to venturi line 38 extends downward until it connects to the venturi chamber 22. The venturi chamber 22 is the component of the present invention in which sand is introduced into the compressed air flow within the invention. The venturi chamber 22 consists of an air injector 42 which connects the manifold to venturi line 38 to the injector chamber 46 of the venturi chamber 22. The air injector 42 extends a short distance into the injector chamber 46 to a point within the injector chamber 46 that is beyond the sand feed tube 44 which directs the flow of sand from the sand outlet 20 to the venturi chamber 22. The flow of the sand in the sand feed tube 44 is controlled by the opening and closing of the sand outlet valve 78 which is located just below the sand storage tank 16 in the sand outlet 20.

The flow of highly compressed air into the injector chamber 46 at a point that is beyond the area at which the sand is introduced, creates a significant amount of negative pressure within the injector chamber 46 which serves to draw sand into the mix chamber 40 located just downstream from the venturi chamber 22. The mix chamber 40 is a hollow cylindrical tube which is designed to throughly mix the air and sand prior to moving to the other components of the invention. Finally, the downstream end of the mix chamber 40 is equipped with the mix chamber venturi 80 which significantly decreases the inside diameter of the components through which the air and sand mixture is traveling which in turn increases the velocity at which it travels. This increase in velocity enhances the effectiveness of the present invention as it tends to pack the sand in a denser fashion at its intended point of deposit.

After leaving the mix chamber 40 through the mix chamber venturi 80, the air and sand mixture travels through the length of the air/sand line 24 to the injector gun 26. The injector gun 26 is the component of the present invention which is used to direct the flow of air and sand into the desired location. The injector gun 26 is generally made up of common pipe fittings which are easily replaceable and very inexpensive. The reason for this method of construction is the abrasive nature and the high velocity of the air and sand mixture will generally wear through them fairly quickly. Thus, the replaceable nature of the components of the injector gun 26 allows for its continuous operation even when a component wear through problem has occurred.

The flow of the air and sand mixture flows from the air/sand line 24 into the injector gun 26 until it is primarily diverted in a downward fashion by the nozzle tee 56. The nozzle tee 56 has connected to its lower end the gun nozzle 54 which is the component of the invention inserted into the damaged area. This insertion is generally accomplished by placing the tip of the gun nozzle 54 into a pre-drilled hole and forcing it down by pounding on the top of the injector gun 26 with a hammer or other heavy tool. The problem with this is that it tends to damage the tip of the gun nozzle 54 and the easily replaceable nature of the gun nozzle 54 is an added advantage of the overall design of the injector gun 26.

The upper end of the nozzle tee 56 serves as the point of attachment for the pressure read chamber 58 which provides a point of attachment for the gun pressure gauge 48. The gun pressure gauge 48 allows the operator to monitor the air pressure within the injector gun 26 which is very important to the proper operation of the present invention. The pressure read chamber 58 is connected to the body of the injector gun 26 through the connector 62 attachment to the nozzle tee 56. The connector 62 is then connected at its upper end to the pressure tee 60 which is plugged at its upper port by the use of the cap 64. This configuration leaves the pressure tee 60 free for the attachment of the pressure read chamber 58. Finally, the pressure read chamber 58 also contains a gun bleed off 50 which is operated through the bleed off valve 52 and allows an operator to relieve any excess or unwanted air pressure which may be present within the injector gun 26.

Figure 6:
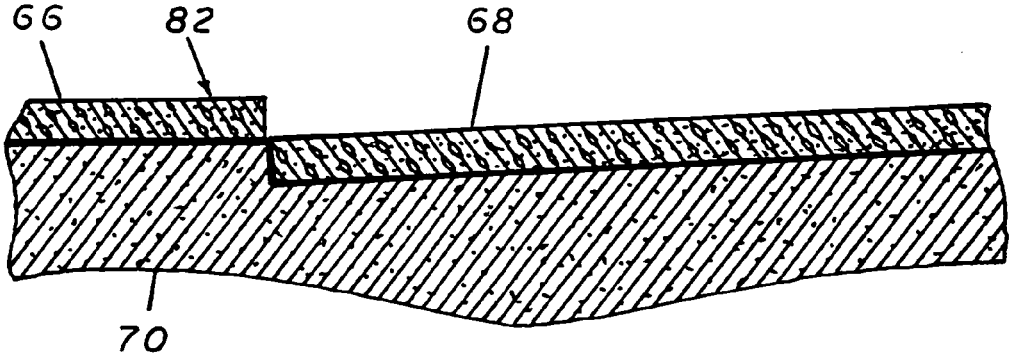
FIG. 6 is a side elevation cross sectional view of a section of typically damaged sidewalk in which one portion has settled into the underlying earth.
Figure 7:
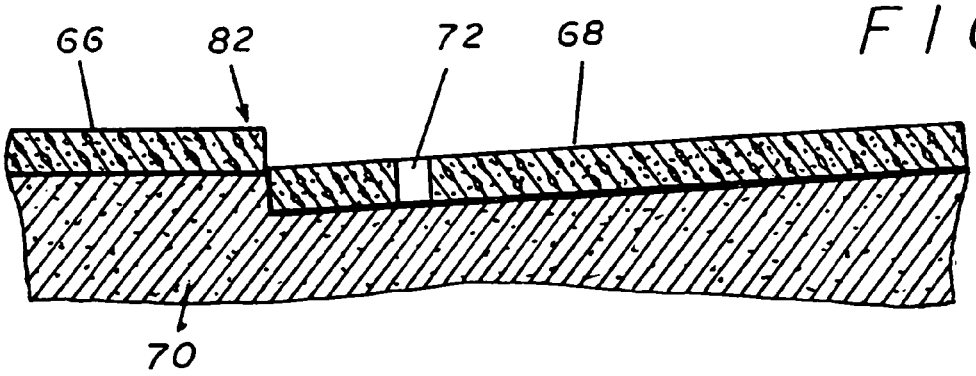
FIG. 7 is a side elevation cross sectional view of a section of typically damaged sidewalk illustrating a settled portion which has been prepared for repair by the addition of the gun nozzle hole through its body.
Figure 8:
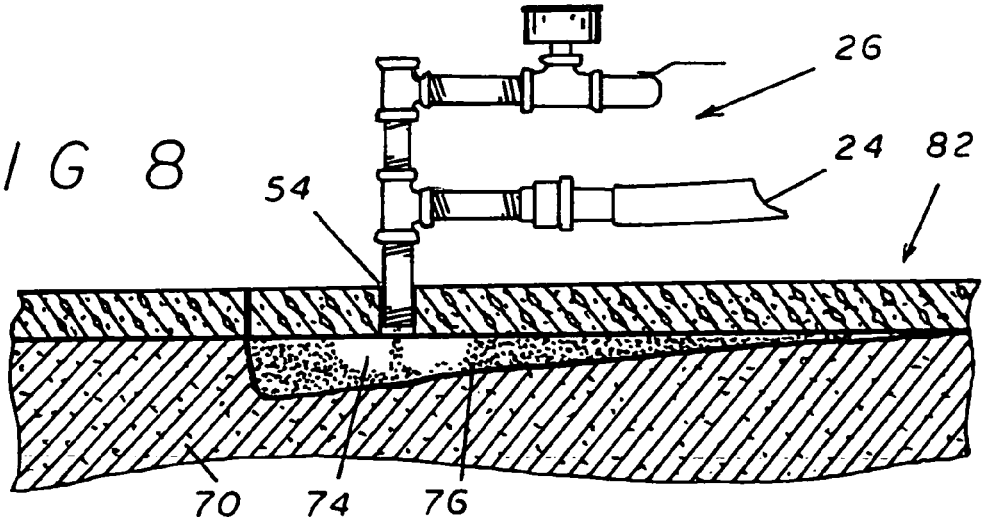
FIG. 8 is side elevation cross sectional view of a section of sidewalk to which is being repaired by the use of the injector gun component of the present invention.

The manner in which the present invention is employed to repair a slab 82 which has been damaged through ground settling is detailed in FIGS. 6, 7, and 8. FIG. 6 illustrates the typical situation in which a damaged slab 68 of a larger slab 82 exists which has in whole or in part settled into the underlying ground 70 below the normal position of a level cement slab 66 of the slab 82. This situation creates a potentially dangerous variance in the heights of neighboring portions of the slab 82 which must be repaired.

The repair process of the present invention is commenced by drilling a gun nozzle hole 72 though % the damaged slab 68 as illustrated in FIG. 7 which provides access to the ground 70 below the damaged slab 68. Upon completion of this step, the gun nozzle 54 of the injector gun 26 is secured within the gun nozzle hole 72 and the operator engages the present invention by providing compressed air flow to the invention's delivery components, sharp blasts or at a steady pressure. The initial effect of these blasts is to momentarily lift the damaged slab 68 off of the underlying ground 70 which creates a settle cavity 74 between them. This settle cavity 74 is then partially filled in by the mason's sand 76 being carried by the compressed before it can drop back down. This process is simply repeated until the upper surface of the damaged slab 68 is at the same elevation as the level cement slab 66 of the slab 82. With this accomplished, the injector gun 26 is removed from the gun nozzle hole 72 which is then filled in with the appropriate material to complete the sidewalk 82 repair process.

Although the present invention has been described in considerable detail with reference to certain preferred versions thereof, other versions are possible. Therefore, the spirit and scope of the appended claims should not be limited to the description of the preferred versions contained herein.

What is claimed is:

1. A method of lifting and leveling a slab by using compressed air to lift said slab and dried sand to stabilize and hold said slab in a desired position said method comprising the steps of:

supplying a sand storage tank filled with a well dried mason's sand said storage tank having a sand outlet;

supplying a compressed air source in fluid tight connection with said sand outlet;

mixing said sand and said compressed air in a mixing chamber;

delivering said sand and air mixture to an injector gun via an elongate fluid tight hose said gun further having a gun nozzle;

drilling a hole in said slab to be leveled;

attaching said gun nozzle to said drilled hole;

operating said injector gun in bursts so as to provide compressed air and sand;

lifting with air pressure, momentarily, said slab to a height above the desired final level with the compressed air supplied by said bursts, such that a settle cavity filled with compressed air sufficient to raise said slab above the ground is created between said slab and said ground until said compressed air escapes from said settle cavity allowing said slab to drop back in contact with said ground such that said slab is supported by said ground and said sand;

leveling said ground with said well dried mason's sand carried by said compressed air in said burst such that said well dried mason's sand may move freely within said settle cavity momentarily created by said compressed air; and repeating said lifting and leveling steps until said slab is at the desired level and resting upon said well dried mason's sand.

2. A method of lifting and leveling a slab by using compressed air to lift said slab and dried sand to stabilize and hold said slab in a desired position as in claim 1 further comprising the step of supplying a compressed air bleed valve between said compressed air source and sand outlet.

3. A method of lifting and leveling a slab by using compressed air to lift said slab and dried sand to stabilize and hold said slab in a desired position as in claim 2 further comprising the step of operating said compressed air bleed valve to release excess pressure.

4. A method of lifting and leveling a slab by using compressed air to lift said slab and dried sand to stabilize and hold said slab in a desired position as in claim 3 further comprising the step of supplying a sand shutoff valve between said sand storage tank and said mixing chamber.

5. A method of lifting and leveling a slab by using compressed air to lift said slab and dried sand to stabilize and hold said slab in a desired position as in claim 4 further comprising the step of adjusting said sand shutoff valve so as to control the flow of sand to said mixing chamber.

6. A method of lifting and leveling a slab by using compressed air to lift said slab and dried sand to stabilize and hold said slab in a desired position said method comprising the steps of:

drilling a strategically placed hole in said slab;

supplying a sand storage tank filled with sand said storage tank having a sand outlet;

supplying a compressed air source in fluid tight connection with said sand outlet;

mixing said sand and said compressed air in a mixing chamber said mixing chamber having a smaller air source hose fitted inside of a larger diameter sand outlet such that said smaller air source extends into the center section of said larger diameter sand outlet so as to create a venturi effect;

delivering said sand and air mixture to an injector gun via an elongate fluid tight hose said injector gun further having a gun nozzle for connection with said hole;

attaching said gun nozzle to said drilled hole; and operating said injector gun so as to provide compressed air and well dried mason's sand;

lifting with air pressure, momentarily, said slab to a height above the desired final level with the compressed air supplied by said injector gun, such that a settle cavity filled with compressed air sufficient to raise said slab above the ground is created between said slab and said ground until said compressed air escapes from said settle cavity allowing said slab to drop back in contact with said ground such that said slab is supported by said ground and said sand;

leveling said ground with said well dried mason's sand carried by said compressed air such that said well dried mason's sand may move freely within said settle cavity momentarily created by said compressed air; and repeating said lifting and leveling steps until said slab is at the desired level and resting upon said well dried mason's sand.

7. A method of lifting and leveling a slab by using compressed air to lift said slab and dried sand to stabilize and hold said slab in a desired position as in claim 6 further comprising the step of supplying a sand shutoff valve that may be adjusted so as to control the flow of sand to said mixing chamber.

8. A method of lifting and leveling a slab by using compressed air to lift said slab and dried sand to stabilize and hold said slab in a desired position as in claim 7 further comprising the step of drilling a second strategically placed hole in said slab; moving said gun nozzle to said second hole and repeating said operating step.

9. A method of lifting and leveling a slab by using compressed air to lift said slab and dried sand to stabilize and hold said slab in a desired position as in claim 8 further comprising the step of patching said holes to match said slab.

10. A method of lifting and leveling a slab by using compressed air to lift said slab and dried sand to stabilize and hold said slab in a desired position as in claim 9 further comprising the step of supplying a compressed air bleed valve between said compressed air source and sand outlet so as to bleed of excess air.

11. A method of lifting and leveling a slab comprising:

drilling a hole through the slab to be leveled;

mixing sand and compressed air in a venturi chamber to create a compressed air and sand mixture;

introducing the compressed air and sand mixture in a first burst underneath the slab via a nozzle that is inserted into the hole in a manner to create an airtight seal between the nozzle and the slab, the nozzle not penetrating into ground underneath the slab, wherein the compressed air of the mixture of the burst raises the slab upward to form a cavity between the slab and ground and the sand of the mixture of the burst partially fills the cavity; and repeating the introduction of the compressed air and sand mixture in one or more additional bursts underneath the slab until the slab is at the desired level and resting upon the sand.

12. The method of claim 11 further comprising drilling a second hole through the slab, inserting the nozzle into the second hole in a manner to create an airtight seal between the nozzle and the slab, and introducing the compressed air and sand mixture in a burst underneath the slab through the nozzle.

13. The method of claim 11 further comprising patching the hole.

14. A method of lifting and leveling a slab, comprising:

introducing a pressurized fluid media underneath the slab so that the introduced pressurized fluid media lifts the slab upward to form a cavity under the slab; and introducing dried material different from the pressurized media into the cavity to at least partially fill the cavity.

15. The method of claim 14, wherein introducing dried material comprises introducing a dried granular material.

16. The method of claim 15, wherein the dried granular material comprises dried masons sand.

17. The method of claim 14, comprising introducing dried material until the slab is at the desired level and resting upon the dried material.

18. The method of claim 14, wherein the pressurized fluid media comprises compressed air, and the compressed air and dried material are introduced simultaneously in a mixture.

* * * * *